US011454466B2

(12) United States Patent
Kim et al.

(10) Patent No.: US 11,454,466 B2
(45) Date of Patent: Sep. 27, 2022

(54) AUTOMATIC WASHING APPARATUS FOR HEAT EXCHANGER BUNDLE

(71) Applicant: BC TAECHANG INDUSTRIAL CORP., Gimhae-si (KR)

(72) Inventors: Do Hyoung Kim, Gimhae-si (KR); Jong Il Kim, Ulsan (KR); Jae Gun Lee, Ulsan (KR); Ki Du Kwon, Ulsan (KR)

(73) Assignee: BC TAECHANG INDUSTRIAL CORP.

( * ) Notice: Subject to any disclaimer, the term of this patent is extended or adjusted under 35 U.S.C. 154(b) by 37 days.

(21) Appl. No.: 17/004,269

(22) Filed: Aug. 27, 2020

(65) Prior Publication Data

US 2021/0131755 A1 May 6, 2021

Related U.S. Application Data

(63) Continuation of application No. PCT/KR2019/016439, filed on Nov. 27, 2019.

(30) Foreign Application Priority Data

Nov. 1, 2019 (KR) ..... 10-2019-0138415

(51) Int. Cl.
*F28G 3/16* (2006.01)
*F28G 15/00* (2006.01)
(Continued)

(52) U.S. Cl.
CPC ..... *F28G 3/163* (2013.01); *F28G 9/00* (2013.01); *F28G 15/003* (2013.01); *F28G 15/02* (2013.01); *F28G 2015/006* (2013.01)

(58) Field of Classification Search
CPC . F28G 3/16; F28G 3/166; F28G 3/163; F28G 9/00; F28G 15/003; F28G 15/02; F28G 15/006
See application file for complete search history.

(56) References Cited

U.S. PATENT DOCUMENTS 2,685,293 A * 8/1954 Elm ..... B24C 3/18 134/159
2,857,922 A * 10/1958 Effinger ..... C23G 3/04 134/159

(Continued)

FOREIGN PATENT DOCUMENTS

JP 2015-081756 A 4/2015
JP 2017-104811 A 6/2017

(Continued)

OTHER PUBLICATIONS

International Search Report (PCT/KR2019/016439), WIPO, dated Jul. 28, 2020.

*Primary Examiner* — Jenna M Hopkins
(74) *Attorney, Agent, or Firm* — Park & Associates IP Law, P.C.

(57) ABSTRACT

An automatic washing apparatus for a heat exchanger is proposed. The automatic washing apparatus is configured to recognize positions of tube holes through a camera, and to automatically wash the tube holes. The automatic washing apparatus is also configured to be able to automatically wash an external bundle and internal tubes of a heat exchanger in accordance with set operation patterns of an external washing module and an internal washing module, and to be able to reuse washing water used for washing a heat exchanger as washing water by reprocessing the washing water.

8 Claims, 11 Drawing Sheets

(51) Int. Cl.
*F28G 15/02* (2006.01)
*F28G 9/00* (2006.01)

(56) References Cited

U.S. PATENT DOCUMENTS 3,052,245 A * 9/1962 Nagle ..... A47L 15/23 15/312.1
3,060,064 A * 10/1962 Zingg ..... C23G 3/04 134/99.1
3,225,777 A * 12/1965 Shelton ..... F28G 15/02 239/587.2
3,703,905 A * 11/1972 Ice, Jr. ..... F28G 15/02 134/152
5,018,544 A * 5/1991 Boisture ..... B08B 9/0433 134/144
9,062,921 B2 * 6/2015 Gromes, Sr. ..... F28G 15/003
9,863,727 B1 * 1/2018 Van Fleet ..... B08B 13/00
10,747,238 B2 * 8/2020 Gromes, Sr. ..... B24C 3/327
10,864,546 B2 * 12/2020 Kim ..... B05B 13/0214
2013/0233350 A1 * 9/2013 Tomkins ..... F28G 9/00 134/109
2016/0033210 A1 * 2/2016 Reich ..... B23P 19/024 29/890.031
2016/0209135 A1 * 7/2016 Moring ..... F28G 15/02
2018/0010867 A1 * 1/2018 Van Fleet ..... B08B 13/00
2020/0132402 A1 * 4/2020 Schneider ..... B08B 9/0325
2020/0333093 A1 * 10/2020 Ferguson ..... F28G 15/04
2020/0356118 A1 * 11/2020 Gromes, Sr. ..... G05D 7/0617
2020/0391257 A1 * 12/2020 Schneider ..... B08B 9/047
2021/0065356 A1 * 3/2021 Fisher ..... G06T 7/62
2021/0131755 A1 * 5/2021 Kim ..... F28G 9/00

FOREIGN PATENT DOCUMENTS

KR 10-0470804 B1 2/2005
KR 20-0476774 Y1 3/2015
WO WO-2019025234 A1 * 2/2019
WO WO-2020218661 A1 * 10/2020 ..... F28G 15/003

* cited by examiner

AUTOMATIC WASHING APPARATUS FOR HEAT EXCHANGER BUNDLE

REFERENCE TO RELATED APPLICATIONS

This is a continuation of International Patent Application PCT/KR2019/016439 filed on Nov. 27, 2019, which designates the United States and claims priority of Korean Patent Application No. 10-2019-0138415 filed on Nov. 1, 2019, the entire contents of which are incorporated herein by reference.

FIELD OF THE INVENTION

The present invention relates to an automatic washing apparatus for a heat exchanger bundle and, more particularly, to an automatic washing apparatus for a heat exchanger bundle, the automatic washing apparatus being able to automatically recognize tens of tubes of a heat exchanger bundle and automatically wash the tubes in accordance with a program.

BACKGROUND OF THE INVENTION

A heat exchanger is used as a condenser in some cases to decrease the temperature of a turbine lubricant using cooling water that circulates in a turbine lubricant cooler or to keep food fresh at a low temperature without spoiling in a refrigerator that is used at home.

In order to wash such heat exchangers, a worker washed bundles and tubes by manually spraying washing water using compressed air or performed washing using an air spray type washing apparatus. An air spray type washing apparatus is a device that washes a tube of a heat exchanger by putting a tube of a cooler in a container fully filled with a detergent, generating bubbles and making the detergent flow using the density difference between the bubbles and the detergent.

When a worker manually washes a tube of a heat exchanger, there is a problem that the worker has difficulty in washing due to fine dust produced when a detergent is sprayed, and it takes long time to completely wash the tube.

Further, when washing a heat exchanger using an air spray type washing apparatus, it is required to fill up a container with a detergent and it is required to additionally inject a detergent into the container because the detergent is evaporated by production of bubbles, so there is a problem that too much detergent is consumed. Further, since only the portions that the detergent comes in contact due to bubbles are washed, uniform washing is difficult.

In order to solve this problem, an apparatus for washing a tube bundle of a cooler has been disclosed in Korean Utility Model Registration No. 20-0476774, but there is a problem that rotary devices are fixed at both ends to be able to rotate a heat exchanger tube, so only heat exchangers with predetermined sizes can be washed. Further, there is a problem that a lot of washing water is consumed because it is impossible to selectively and precisely wash each tube of a heat exchanger.

SUMMARY OF THE INVENTION

Accordingly, in order to solve the problems of the related art, an objective of the present invention is to provide an automatic washing apparatus for a heat exchanger bundle, the automatic washing apparatus being able to quickly wash the inside of a tube by accurately recognizing the position of a heat exchanger bundle tube and set coordinates on a map.

Another objective of the present invention is to provide an automatic washing apparatus for a heat exchanger bundle, the automatic washing apparatus being able to automatically wash an external bundle and an internal tube of a heat exchanger using a control module in accordance with set operation patterns of an external washing module and an internal washing module.

Another objective of the present invention is to provide an automatic washing apparatus for a heat exchanger bundle, the automatic washing apparatus being able to rotate a heat exchanger bundle while adjusting a gap for supporting the bottom of the heat exchanger bundle regardless of the length of a heat exchanger.

Another objective of the present invention is to provide an automatic washing apparatus for a heat exchanger bundle, the automatic washing apparatus in which a nozzle feeder of an internal washing module is inserted into or taken out of a tube at an accurate position by automatically recognizing the position of the heat exchanger tube.

Another objective of the present invention is to provide an automatic washing apparatus for a heat exchanger bundle, the automatic washing apparatus being able to reuse the washing water used for washing a heat exchanger by reprocessing the washing water.

In order to achieve the objectives, the present invention provides an automatic washing apparatus for a heat exchanger bundle, the automatic washing apparatus including: a chamber being able to keep a heat exchanger bundle therein and having a frame therein; an internal washing module disposed at a side of the frame, being able to move in X-axial, Y-axial, and Z-axial directions, enabling washing water to be sprayed into tubes of the heat exchanger bundle; a camera photographing the tubes of the heat exchanger bundle; and a control module connected with the camera, receiving a photograph of the tubes of the heat exchanger bundle, making a map by setting coordinates of each of the tubes of the heat exchanger bundle on the basis of a predetermined program, and controlling operation of the internal washing module on the basis of the map.

According to the automatic washing apparatus for a heat exchanger of the present invention, since tubes of a heat exchanger bundle are recognized through a camera and the inside of the tubes of the heat exchanger bundle are automatically washed by a program that designates coordinates on the basis of a map, whereby quick and accurate washing is possible.

It is possible to automatically wash an external bundle and internal tubes of a heat exchanger by driving an external washing module and an internal washing module in accordance with a washing position and a washing order set by a worker.

Since it is possible to adjust the gaps of bundle rotation modules that support a heat exchanger bundle, it is possible to heat exchanger bundles having various lengths.

It is possible to wash the entire surface of a heat exchanger bundle by automatically rotating the heat exchanger bundle and a worker can visually check a position not sufficiently washed or a position that needs to be washed.

Since the positions of heat exchanger tubes are automatically recognized and nozzle feeders of the internal washing module are inserted into or taken out of tubes at accurate positions, work time can be reduced and work cost can be decreased by automation.

Since it is possible to reuse washing water used for washing a heat exchanger as washing water by reprocessing the washing water, there is an effect that eco-friendly work is possible and the cost is reduced.

DETAILED DESCRIPTION OF THE INVENTION

Hereinafter, embodiments of the present invention will be described in detail with reference to the accompanying drawings. However, in the following description of the present invention, well-known functions or configurations will not be described to make the spirit of the present invention clear.

Further, in the following description of the present invention, terms indicating directions define relative directions so that those skilled in the art can clearly understand the present invention, and the right range of the present invention is not limited thereto.

Figure 1:
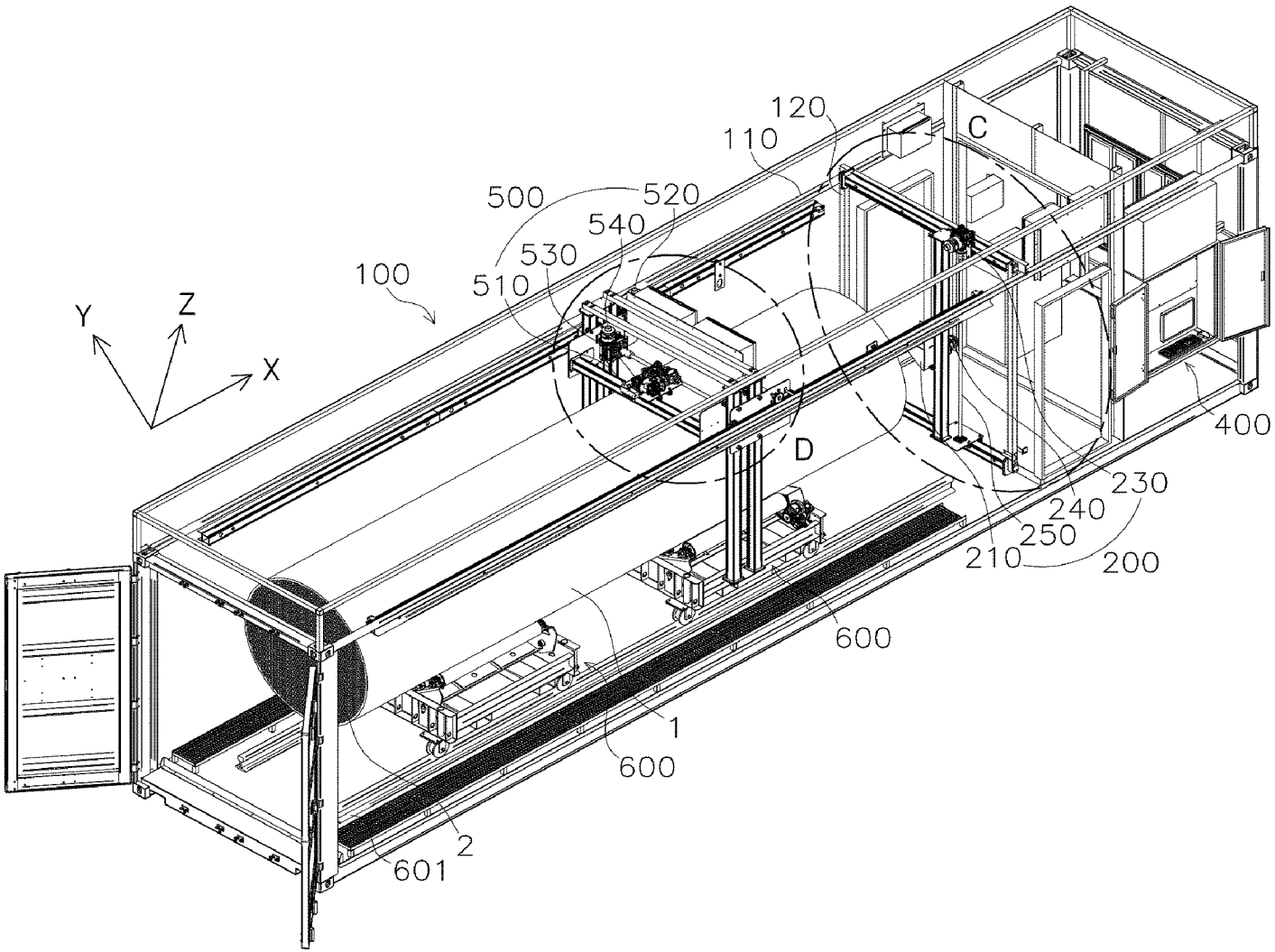
FIG. 1 is a perspective view of an automatic washing apparatus for a heat exchanger bundle according to an embodiment of the present invention.
Figure 2:
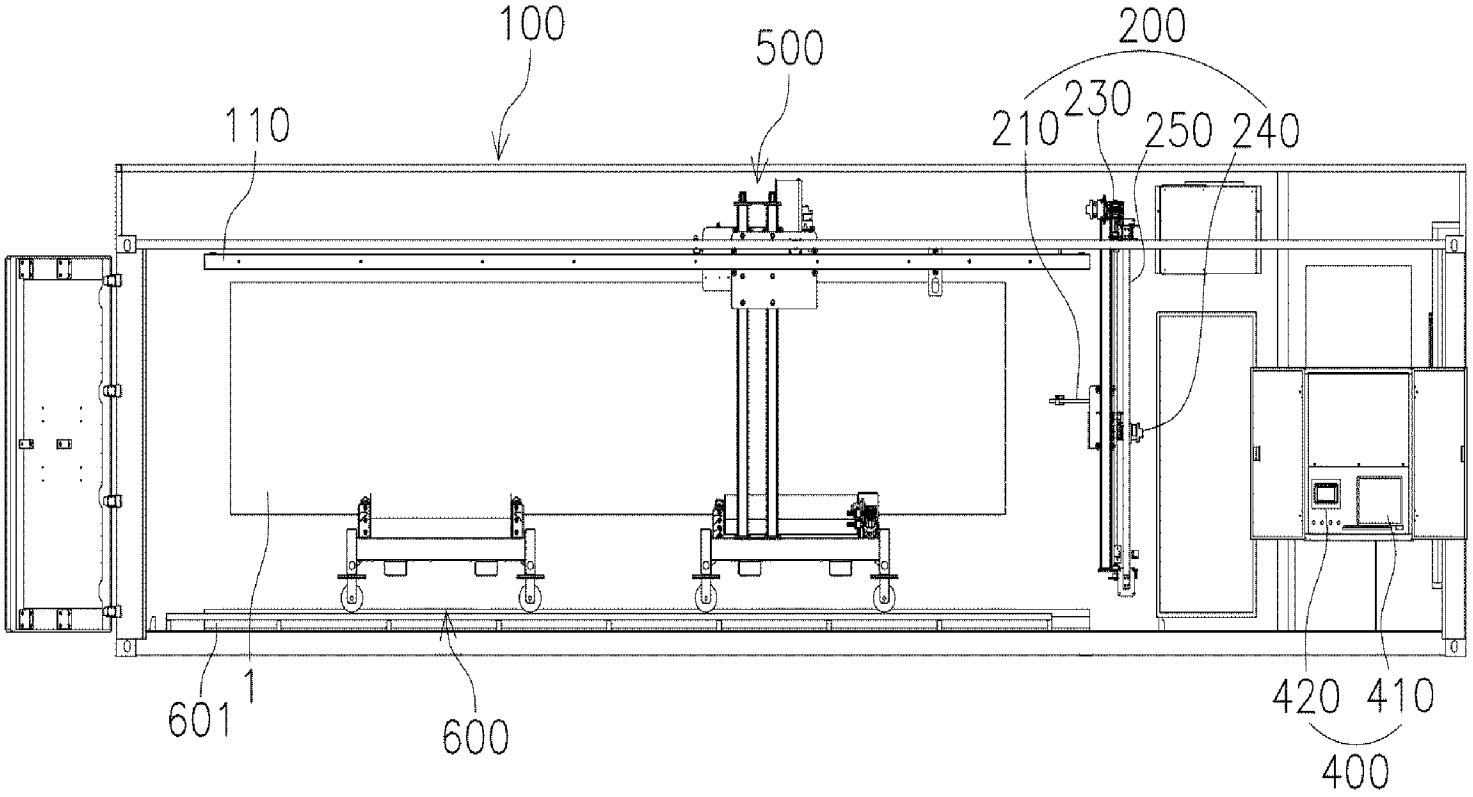
FIG. 2 is a side view of FIG. 1.
Figure 3:
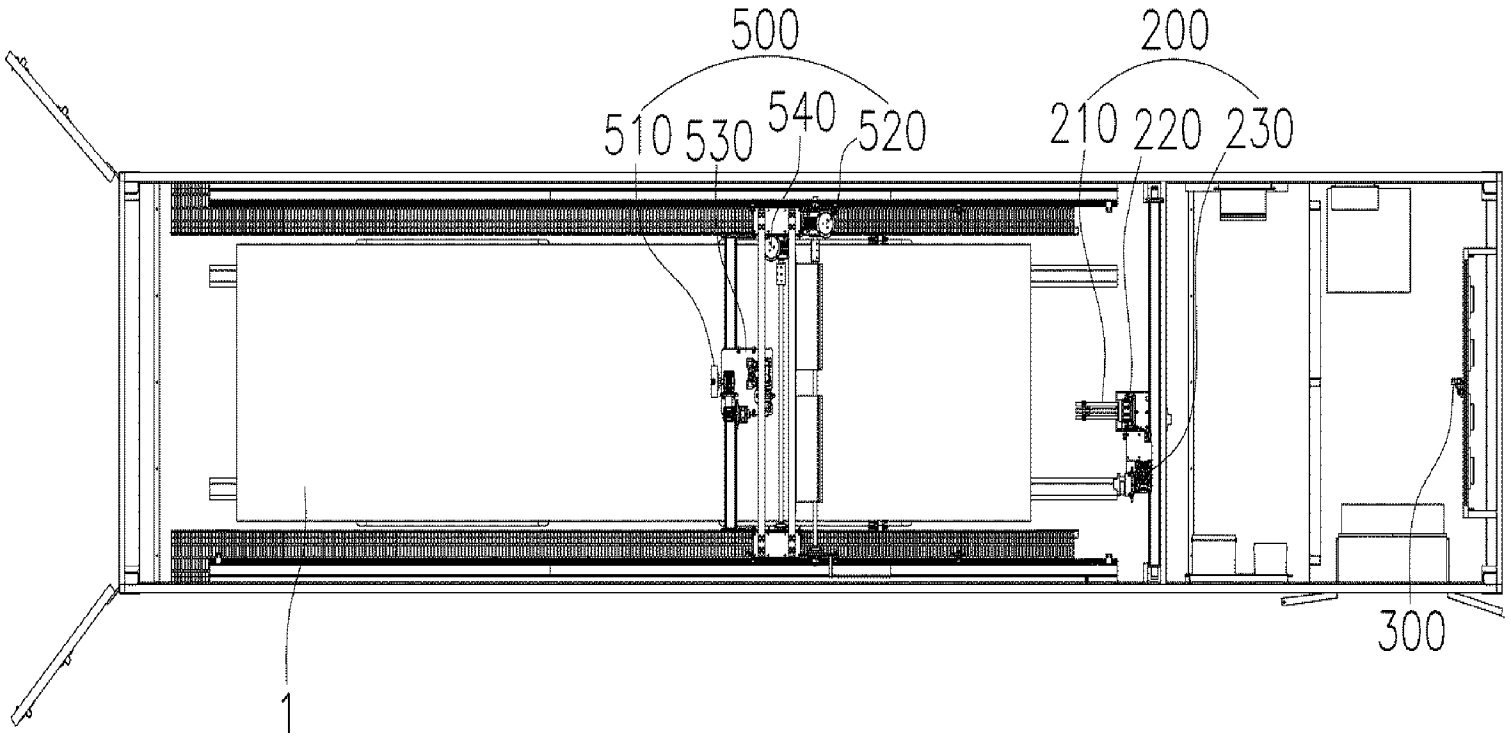
FIG. 3 is a plan view of FIG. 1.

FIG. 1 is a perspective view of an automatic washing apparatus for a heat exchanger bundle according to an embodiment of the present invention, FIG. 2 is a side view of FIG. 1, and FIG. 3 is a plan view of FIG. 1.

Referring to FIGS. 1, 2, and 3, an automatic washing apparatus for a heat exchanger bundle according to an embodiment of the present invention fundamentally includes a chamber 100, an internal washing module 200, a camera 300, and a control module 400, and may further include an external washing module 500, a bundle rotation module 600, and a waste water processing unit (not shown).

The chamber 100 is a structure that can accommodate a heat exchanger bundle 1 therein.

The internal washing module 200, the camera 300, and the control module 400 may be installed in the chamber 100 to wash the heat exchanger bundle 1 disposed in the chamber 100. Further, a frame 120 is installed in the chamber 100 and the internal washing module 200 can be hung on the frame 120.

The chamber 100 has a long hexahedron shape, keeps the heat exchanger bundle 1, and provides an internal darkroom, so photographing by the camera 300 can be smoothly performed and it is possible to prevent washed contaminants from be sprayed outside in washing.

If necessary, one side and the top of the chamber 100 may be open so that a worker can check a washing process. Further, one side of the chamber 100 may be opened and closed so that it is possible to put and wash the heat exchanger bundle 1 in the chamber 100 and take the heat exchanger bundle 1 out of the chamber 100 after finishing washing. In this configuration, guide rails 601 may be installed on the floor inside the chamber 100 so that the heat exchanger bundle 1 can be smoothly moved by the bundle rotation module 600.

The internal washing module 200 is a part for washing the insides of tubes 2 of the heat exchanger bundle 1.

The internal washing module 200 is disposed on the frame 120 in the chamber 100. The internal washing module 200 is laterally moved by a motor and sprays washing water into the tubes 2 of the heat exchanger bundle 1.

Figure 4:
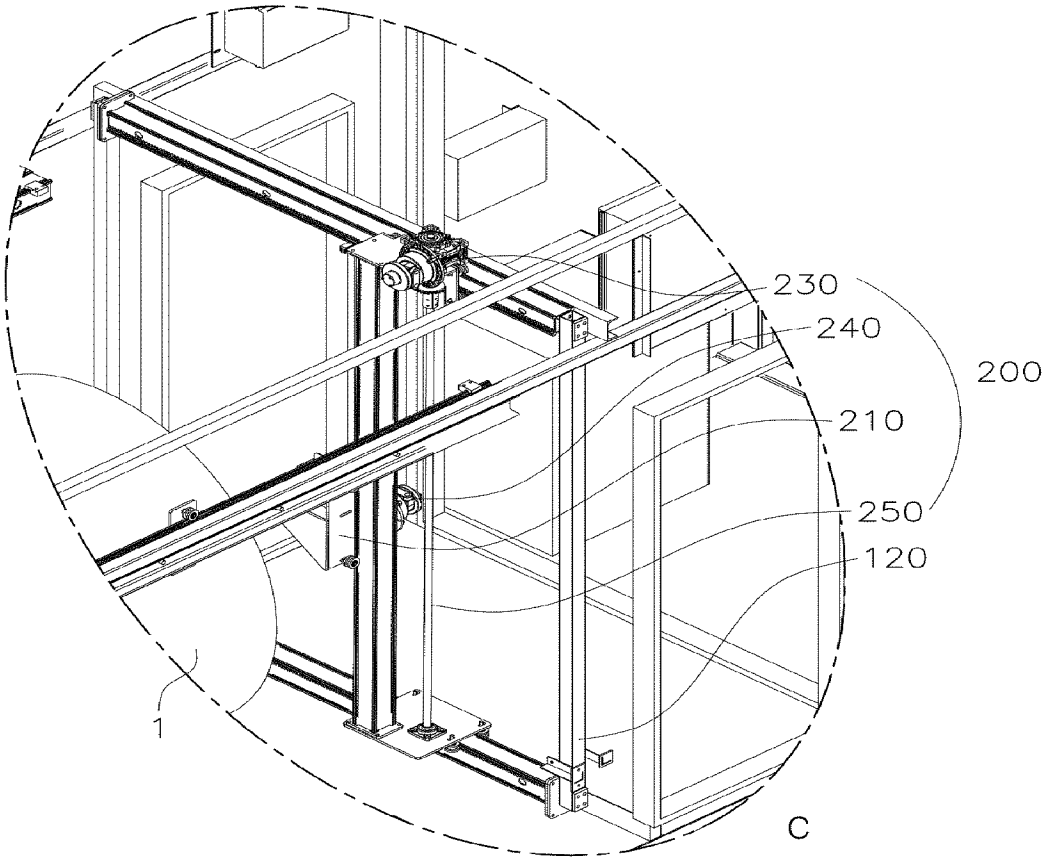
FIG. 4 is a partially enlarged view of the portion C of FIG. 1.
Figure 5:
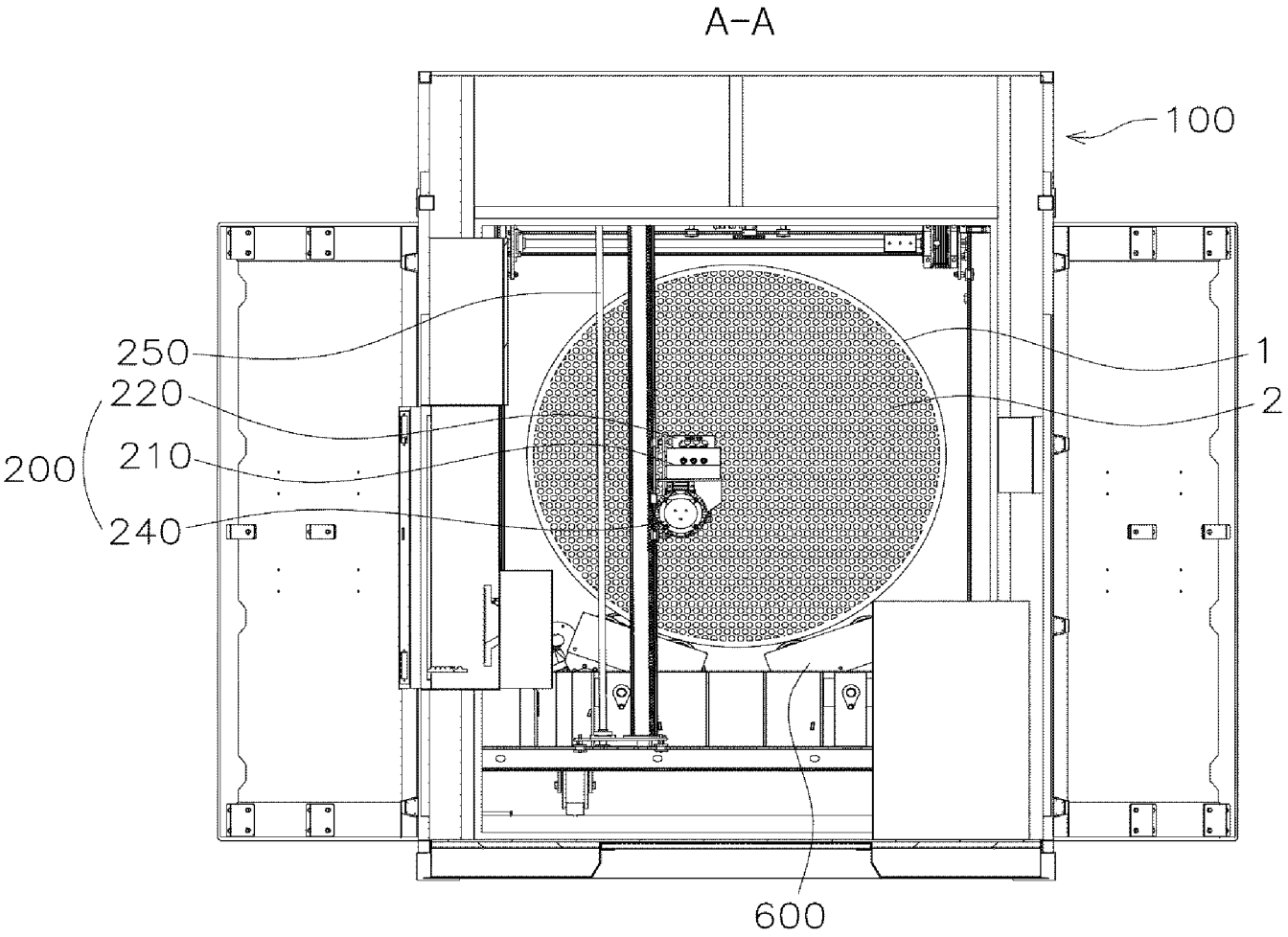
FIG. 5 is a cross-sectional view showing a side of the cross-section A-A of FIG. 2.

In detail, referring to FIGS. 4 and 5, the internal washing module 200 includes an internal washer 210, a nozzle feeder actuator 220 (FIG. 3), a tube Y-axis actuator 230, and a tube Z-axis actuator 240.

The internal washer 210 has a nozzle feeder that sprays washing water into the tubes 2 of the heat exchanger bundle 1 and is moved by the nozzle feeder actuator 220 (FIG. 3), the tube Y-axis actuator 230, and the tube Z-axis actuator 240.

The nozzle feeder actuator 220 (FIG. 3) can move the internal washer 210 in the X-axial direction, so it inserts or takes the nozzle feeder into or out of the tube 2 of the heat exchanger bundle 1.

The tube Y-axis actuator 230 moves the internal washer 210 left and right with respect to the bundle 1. The tube Y-axis actuator 230 has an extension shaft 250 that is operated by rotation of a motor and gears are disposed at the upper end and the lower end of the extension shaft and can rotate in mesh with rails on an upper frame and a lower frame.

The tube Z-axis actuator 240 moves the internal washer 210 up and down with respect to the bundle.

The internal washing module 200 further includes rails, driving wheels, and rollers to be able to axially move, but these components are not described.

The camera 300 is a part that photographs the tubes of the heat exchanger bundle.

In detail, the camera 300 is installed in the chamber 100 and can photograph the tubes 2 of the heat exchanger bundle 1 under the darkroom condition of the chamber 100, whereby it is possible to check the number of the tubes 2. Further, a separate light may be installed at the upper, lower, and rear portions of the camera 300. It is possible to check the number and shape of tubes 2 by taking pictures of the tubes 2 of the heat exchanger bundle 1 using the camera 300.

The control module 400 is a part that controls washing of the heat exchanger bundle.

The control module 400 may be composed of a computer 410 and a PLC 420.

The computer 410 is connected with the camera 300, receives an image of the tubes 2 of the heat exchanger bundle 1, makes a map by setting coordinates of each of the tubes 2 of the heat exchanger bundle 1, and transmits the coordinates to the PLC 420. The computer 410 can increase the recognition rate of the insides of the tubes 2 of the heat exchanger bundle 1, that is, holes, using deep learning software, and has a function of keeping a map. When there is an error in recognition of a hole, a worker can perform adding or removing.

In the present invention, it is possible to set coordinates of tubes or holes and sequentially express coordinates Ym and Zm (m is the order, which may be set to sequentially increase from a reference order 1).

The computer 410 can recognize the insides of the tubes as holes from the image of the tubes 2 of the heat exchanger bundle 1 transmitted from the camera 300, digitize the diameters of the holes and the distances between the holes, and show a hole as an error when the diameter of the hole is out of a predetermined tolerance range from an average value or is out of a predetermined tolerance range from an average value of the distance of the hole. A worker can correct the error.

The PLC 420 controls the operation of the internal washing module 200 in the Y-axial and Z-axial directions in accordance with the coordinates on the basis of the map, whereby it is possible to sequentially wash the insides of the tubes 2 of the heat exchanger bundle 1. The number of nozzle feeders of the internal washing module 200 is selectively programmed in a control module, so a tube is washed on the basis of the number of nozzle feeders and it is required to prevent repeated washing.

The movement distance of the external washing module 500 is checked by an encoder installed in each module, and when there is an error in the movement distance, position correction is performed to further move the external washing module 500 by the error.

It is possible to display a tube 2, which has been washed, on a display by transmitting information of the tube that has been washed of the tubes 2 of the heat exchanger bundle 1 to the computer 410.

The external washing module 500 is disposed at front and rear portions of the frame 110 to wash the outside of the heat exchanger bundle 1. The external washing module 500 can be axially moved by a motor and can wash the outside of the heat exchanger bundle by spraying washing water.

Figure 6:
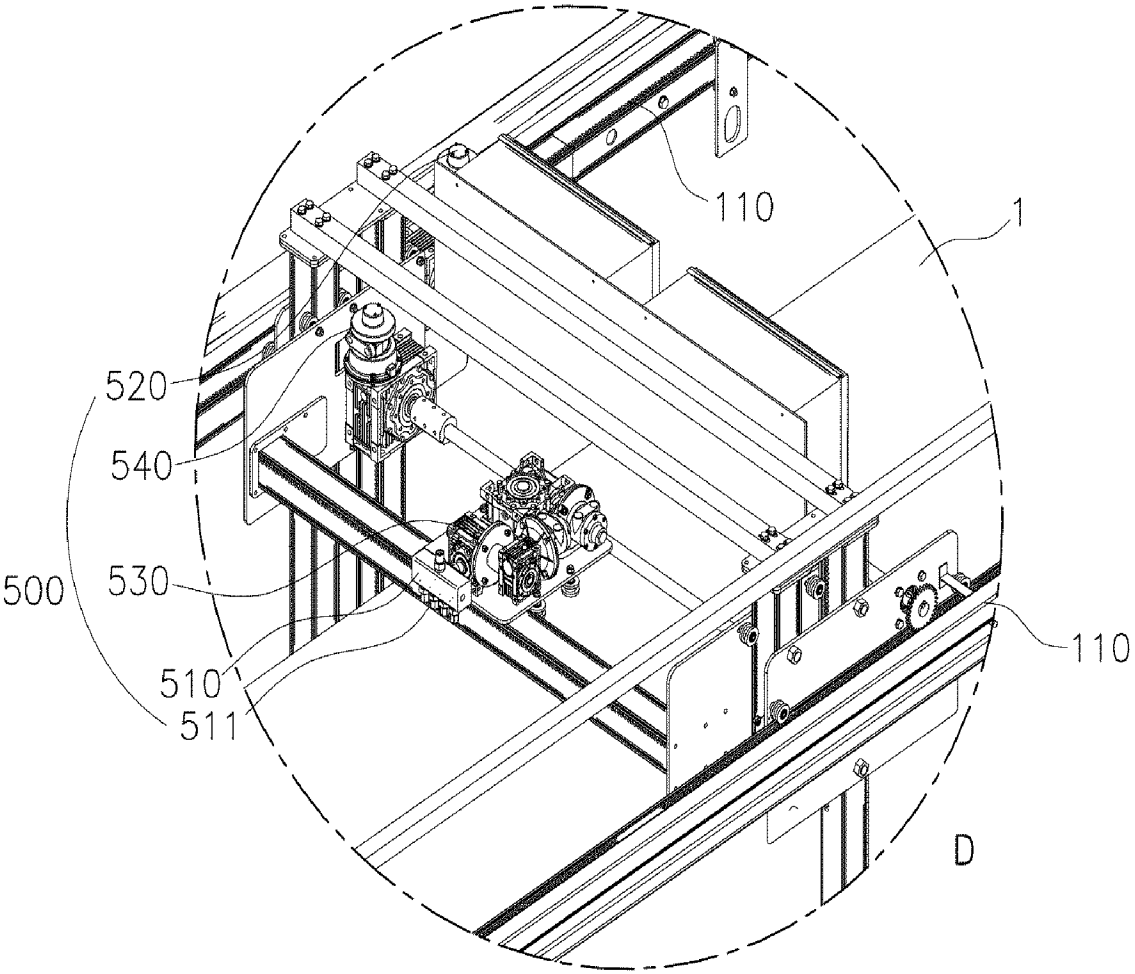
FIG. 6 is a partial enlarged view of the portion D of FIG. 1.

In detail, referring to FIG. 6, the external washing module 500 includes an external washer 510, a bundle X-axis actuator 520, a bundle Y-axis actuator 530, and a bundle Z-axis actuator 540.

The external washer 510 has a nozzle head 511 for spraying washing water to the outer side of the heat exchanger bundle 1 and is moved by the bundle X-axis actuator 520, the bundle Y-axis actuator 530, and the bundle Z-axis actuator 540.

The bundle X-axis actuator 520 moves the external washer 510 in the longitudinal direction of the heat exchanger bundle.

The bundle Y-axis actuator 530 moves the external washer 510 left and right with respect to the heat exchanger bundle.

The bundle Z-axis actuator 540 moves the external washer 510 up and down with respect to the heat exchanger bundle.

The external washing module 500 further includes rails, driving wheels, and rollers to be able to axially move. The rails are disposed in the X-axial, Y-axial, and Z-axial directions and have a plurality of movement guide holes longitudinally formed with predetermined gaps on a side. The driving wheels are formed in gear shapes, are rotated by a motor, and are axially moved while teeth are sequentially inserted into the movement guide holes of the rails. The rollers are symmetrically disposed on a side and the other side of each of the rails and enables smooth movement by distributing load that is applied to the driving wheels.

In FIG. 1, the bundle rotation modules 600 are disposed at both sides under the frame 110, are operated to be able to support and rotate the heat exchanger bundle, and move a heat exchanger into or out of the chamber 110 along the guide rails 601.

Figure 7:
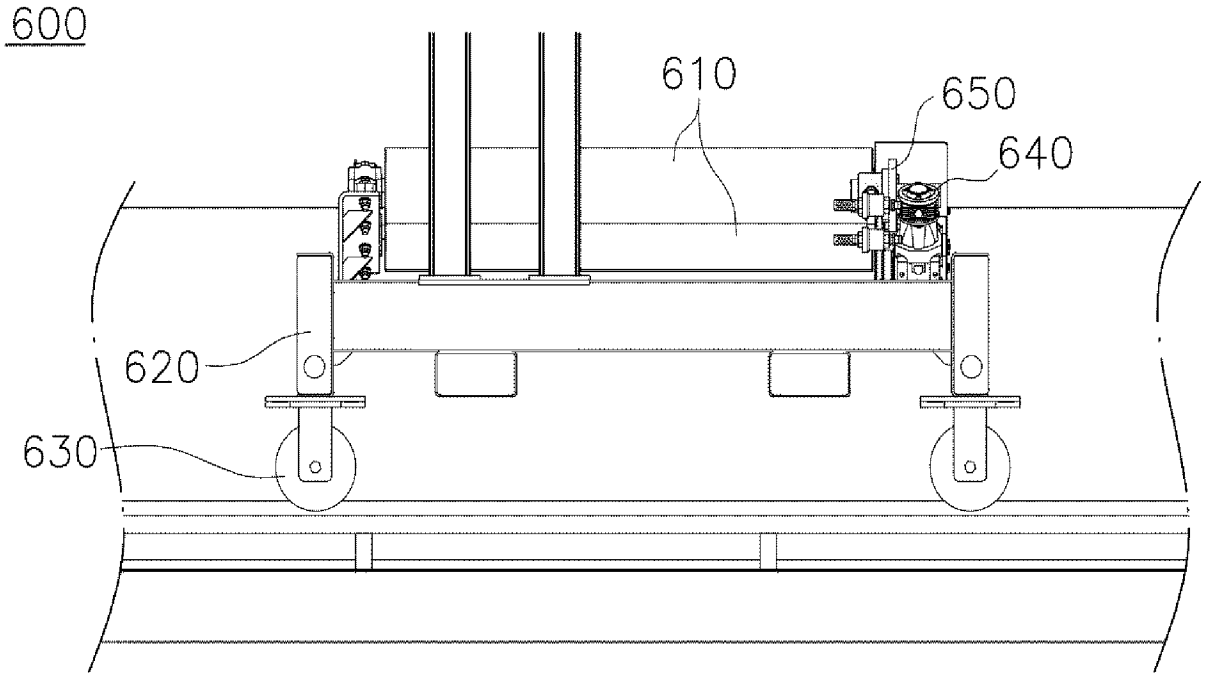
FIG. 7 is a view showing the configuration of a bundle rotation module according to an embodiment of the present invention.

The bundle rotation module 600, referring to FIG. 7, includes bundle rotors 610, connection brackets 620, and bundle movers 630.

The bundle rotors 610 are formed in roller shapes, are symmetrically disposed front and back in the longitudinal direction of the bundle, and can support and rotate the bundle. A motor 650 and a reducer 640 are connected to the rotors 610 and can be driven by the control module. The bundle rotors 610 may be disposed at both ends of the heat exchanger bundle, and may be additionally disposed at the center of a bundle, depending on the length of a heat exchanger, thereby being able to make rotation smooth.

The connection brackets 620 are formed in rectangular frame shapes and are coupled to the bottom of a pair of bundle rotors 610, thereby connecting the bundle rotors 610. The connection brackets 620 may have a structure that can support the weight of a heat exchanger bundle.

The bundle movers 630 are disposed at the both front and rear lower ends of the connection brackets 620 to correspond to the positions of the pair of bundle rotors 610, and the positions of the bundle movers 630 can be adjusted in accordance with the length of a heat exchanger bundle.

Figure 8:
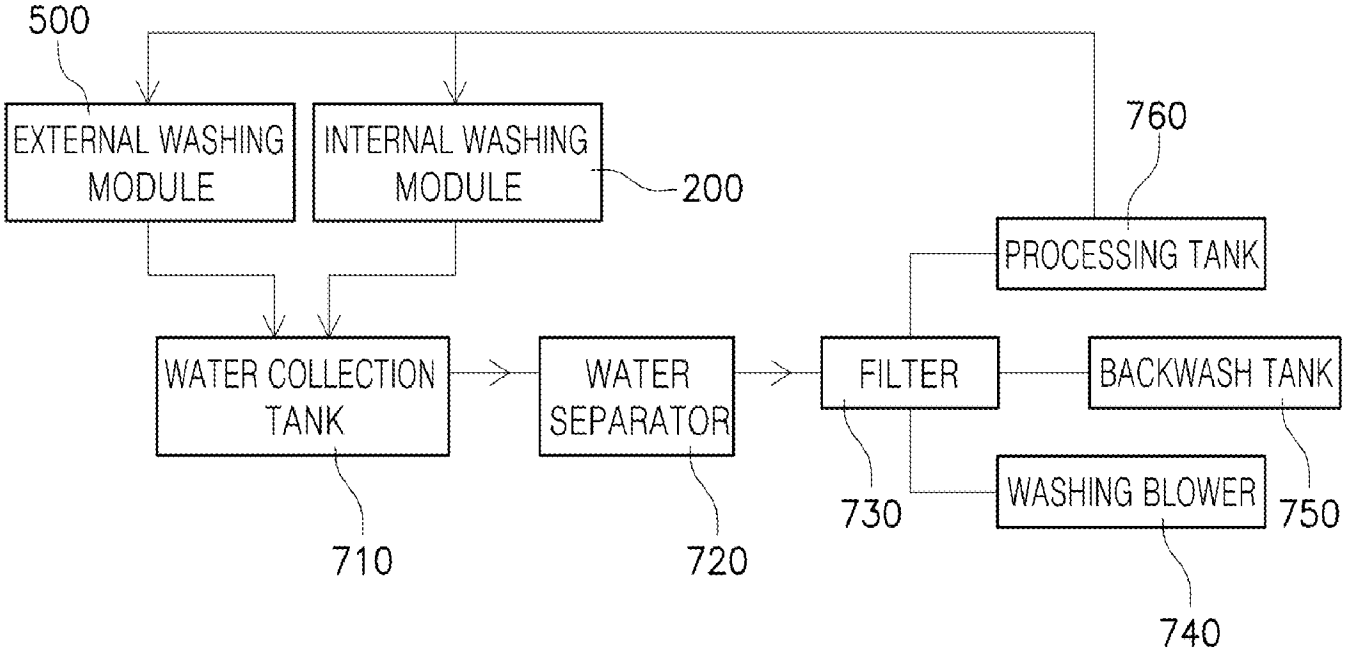
FIG. 8 is a view showing a process of processing washing water according to an embodiment of the present invention.
Figure 9:
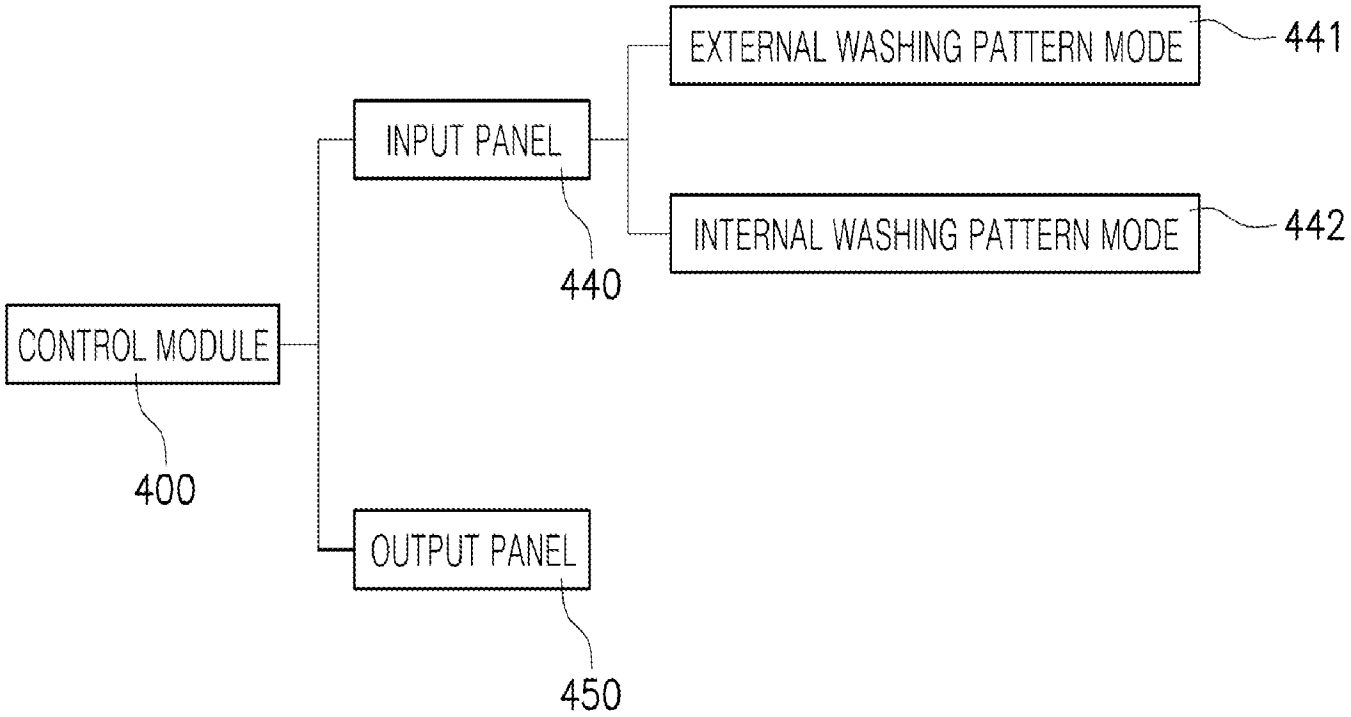
FIG. 9 is a block diagram of a control module according to an embodiment of the present invention.
Figure 10:
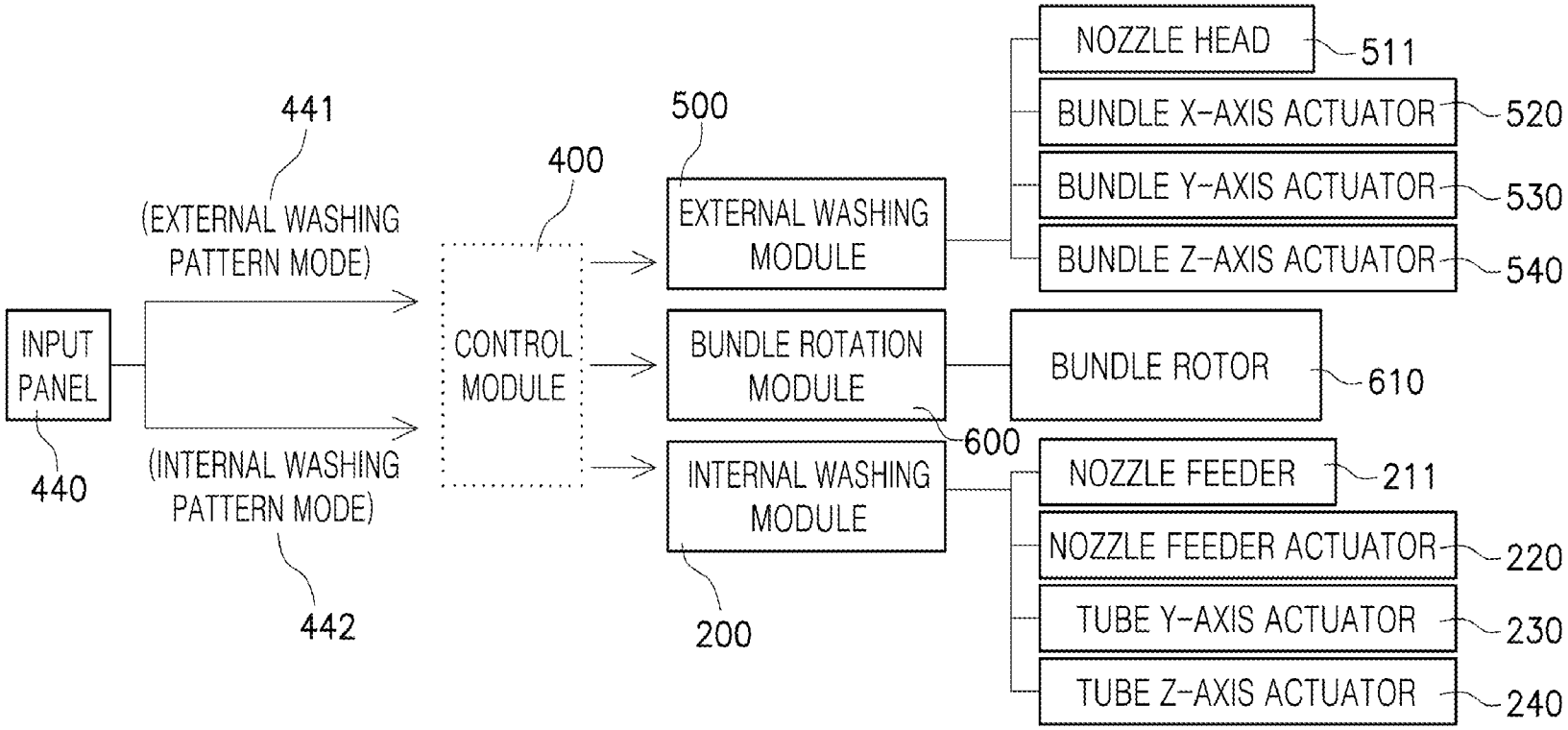
FIG. 10 is a view showing control of an automatic washing apparatus for a heat exchanger bundle according to an embodiment of the present invention.

Referring to FIGS. 8 to 10, the control module 400 controls the operations of the internal washing module 200, the external washing module 500, and the bundle rotation module 600 in accordance with set operation patterns. The control module 400 may be composed of an electric controller, a PLC electronic controller, and a pneumatic circuit. A work result is shown in an output panel 450, so a worker can easily check the work result.

Referring to FIGS. 8 to 10, a worker inputs an external washing pattern mode 441 and an internal washing pattern mode 442 through an input panel 440 of the control module 400, whereby the operations of the internal washing module 200, the external washing module 500, and the bundle rotation module 600 can be set in advance.

In the external washing pattern mode 441, the operation pattern of the external washing module 500 is set in accordance with the washing position and washing order of a heat exchanger bundle. The control module 400 enables the entire surface of a bundle to be uniformly washed by rotating the bundle with predetermined intervals by driving the bundle rotation module 600 in accordance with the external washing pattern mode 441 when washing a heat exchanger bundle.

In the internal washing pattern mode 442, the operation pattern of the internal washing module 200 is set in accordance with the washing positions and washing order of the tubes on the basis of coordinates received from the computer of the control module 400. In particular, a map is made by recognizing the position of a tube through the camera and setting coordinates through the computer, whereby the internal washer of the internal washing module 200 can be automatically driven by PLC setting.

The operations of the internal washing module 200, the external washing module 500, and the bundle rotation module 600 are automatically controlled in accordance with the external washing pattern mode 441 and the internal washing pattern mode 442 set in the control module 400, whereby it is possible to wash a large amount of heat exchange within a short time and it is possible to accurately and completely wash set points.

Figure 11:
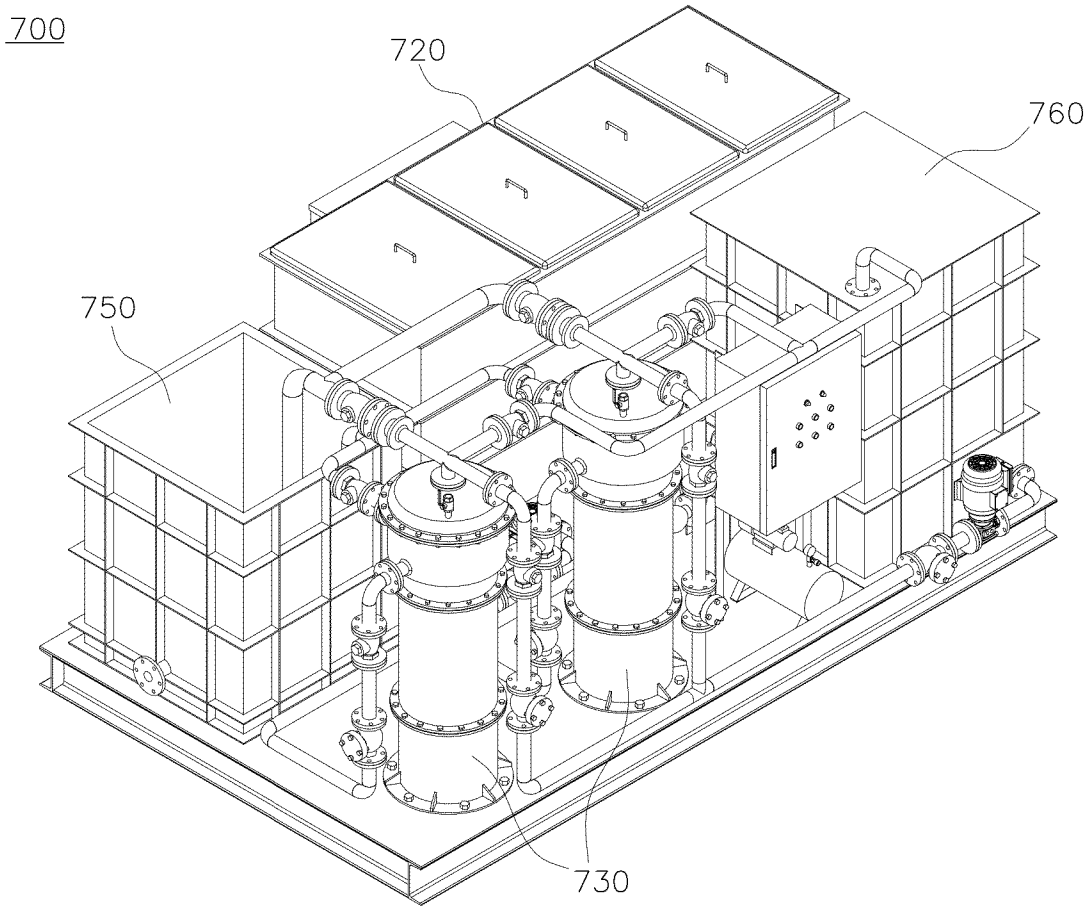
FIG. 11 is a perspective view of a waste water processing unit according to an embodiment of the present invention.

Referring to FIGS. 8 and 11, the waste water processing unit 700, which filters washing water used in the internal washing pattern mode 442 and the external washing pattern mode 441 to reuse the wash in water, includes a water collection tank 710, a water separator 720, a filter 730, a washing blower 740, a backwash tank 750, and a processing tank 760.

The water collection tank 710 collects washing water used by the internal washing module 200 and the external washing module 500 and supplies the washing water to the water separator 720.

The water separator 720, receives washing water from the water collection tank 710 and separates the washing water into water and oil, has a structure in which a plurality of plates having egg plate shapes are stacked, thereby being able to separate washing water into water and oil within a short time.

The filter 730, which filters out foreign substances from the water separated by the water separator 720, has a plurality of stacked fiber filters, thereby being able to secure a large filtering area.

The washing blower 740 is disposed at the inlet of the filter 730 and increases the flow rate of washing water.

The backwash tank 750 is connected to the filter 730 to wash out the filtered floating particles.

The processing tank 760 is disposed at the outlet of the filter 730 to supply the filtered washing water back to the internal washing module 200 and the external washing module 500.

As described above, it can be seen that the fundamental spirit of the present invention is to provide an automatic washing apparatus for a heat exchanger, the automatic washing apparatus being able to automatically wash the outside of a heat exchanger bundle and the inside of a tube in accordance with the set operation patterns of an internal washing module and an external washing module and being able to reuse washing water used for washing a heat exchanger as washing water by reprocessing the washing water.

The present invention may be modified in various ways by those skilled in the art within the range of the spirit of the present invention, and accordingly, the scope of the present invention should be construed within the claims including various modifications.

What is claimed is:

1. An automatic washing apparatus for a heat exchanger bundle, the automatic washing apparatus comprising:

a chamber configured to accommodate the heat exchanger bundle therein and having a frame therein;

an internal washing module disposed at a side of the frame, the internal washing module configured to move in X-axial, Y-axial, and Z-axial directions, and enabling washing water to be sprayed into tubes of the heat exchanger bundle;

a camera configured to capture an image of the tubes of the heat exchanger bundle; and a control module coupled to the camera, and configured to receive the captured image of the tubes of the heat exchanger bundle, provide a map by setting coordinates of each of the tubes of the heat exchanger bundle, and control operation of the internal washing module based on the map, wherein the control module includes a computer for setting coordinates of the captured image, and a PLC for controlling the internal washing module on the basis of the coordinates transmitted from the computer and configured to correct a movement difference when an error is detected, wherein the computer is configured to identify insides of the tubes as holes from the captured image of the tubes of the heat exchanger bundle transmitted from the camera, calculate diameters of the holes and distances between the holes, and identify a hole as an error when the diameter of the hole is out of a predetermined tolerance range from an average value or is out of a predetermined tolerance range from an average value of the distances of the holes.

2. The automatic washing apparatus of claim 1, wherein the internal washing module includes:

an internal washer having nozzle feeders for spraying washing water into the tubes;

a nozzle feeder actuator configured to move the nozzle feeders in the X-axial direction by reciprocating the nozzle feeders into or out of the tubes of the heat exchanger bundle;

a tube Y-axis actuator for laterally moving the internal washer with respect to the tubes of the heat exchanger bundle; and a tube Z-axis actuator for moving the internal washer up and down with respect to the tubes of the heat exchanger bundle.

3. The automatic washing apparatus of claim 1, further comprising an external washing module for spraying washing water to an outer side of the heat exchanger bundle while moving in the X-axial, Y-axial, and Z-axial directions.

4. The automatic washing apparatus of claim 3, further comprising a waste water processing unit including a water separator that separates washing water used by the external washing module and the internal washing module and a filter that filters out foreign substances from the water separated by the water separator, and re-supplying and circulating the water filtered by the filter to the external washing module and the internal washing module to reuse the water.

5. The automatic washing apparatus of claim 3, wherein the external washing module includes:

an external washer having a nozzle head spraying washing water to the outer side of the heat exchanger bundle;

a bundle X-axis actuator for moving the external washer in a longitudinal direction of the heat exchanger bundle;

a bundle Y-axis actuator for moving the external washer left and right with respect to the heat exchanger bundle; and a bundle Z-axis actuator for moving the external washer up and down with respect to the heat exchanger bundle.

6. The automatic washing apparatus of claim 3, wherein the control module includes:

an external washing pattern mode in which an operation pattern of the external washing module is set in accordance with a washing position and a washing order of the heat exchanger bundle; and an internal washing pattern mode in which an operation pattern of the internal washing module is set in accordance with washing positions and a washing order of the tubes of the heat exchanger bundle.

7. The automatic washing apparatus of claim 1, further comprising a bundle rotation module disposed under the frame and operating to be able to support and rotate the heat exchanger bundle.

8. The automatic washing apparatus of claim 7, wherein the bundle rotation module includes:

a pair of bundle rotors formed in roller shapes, arranged in a longitudinal direction of the heat exchanger bundle, and disposed symmetrically left and right under the heat exchanger bundle;

connection brackets formed in rectangular frame shapes and mounted on bottoms of the pair of bundle rotors; and bundle movers disposed at both left and right lower ends of the connection brackets to correspond to the positions of the pair of bundle rotors, and being able to be adjusted in position in accordance with a length of the heat exchanger bundle.

* * * * *